United States Patent [19]

Rullo et al.

[11] Patent Number: 4,938,313

[45] Date of Patent: Jul. 3, 1990

[54] CUSHIONED WRAP-AROUND PAD FOR USE WITH A POLE OR TREE CLIMBER

[75] Inventors: James J. Rullo, Elmira; Mark A. Colian, Binghamton, both of N.Y.

[73] Assignee: Buckingham Manufacturing Company, Inc., Binghamton, N.Y.

[21] Appl. No.: 280,772

[22] Filed: Dec. 7, 1988

[51] Int. Cl.[5] ..... A63B 27/00

[52] U.S. Cl. ..... 182/221; 182/134

[58] Field of Search ..... 182/221, 135, 134, 3

[56] References Cited

U.S. PATENT DOCUMENTS

| | | | |
|---|---|---|---|
| 672,755 | 4/1901 | Dumbolton | 182/221 |
| 1,727,237 | 9/1929 | Katz | 182/221 |
| 2,760,705 | 8/1956 | McIntire | 182/221 |
| 4,530,420 | 7/1985 | Hobbs | 182/134 |
| 4,666,017 | 5/1987 | Zimmerman | 182/3 |
| 4,730,702 | 3/1988 | Torbett | 182/221 |

*Primary Examiner*—Reinaldo P. Machado

*Attorney, Agent, or Firm*—Salzman & Levy

[57] ABSTRACT

The invention features a wrap-around pad that attaches to a climber harness for securing the climber harness to a leg of a lineman or lumberjack.

The wrap-around pad completely encircles the circumfernce of the upper tibia portion of the leg, thus providing increased support and comfort to the leg. The surfaces of the pad is covered by Velcro-type mating linings comprising hooks and loops, such that the pad adjusts to the leg size by securing itself to itself. This allows for securement to the leg without the use of straps, and allows for quick release and adjustment.

23 Claims, 1 Drawing Sheet

CUSHIONED WRAP-AROUND PAD FOR USE WITH A POLE OR TREE CLIMBER

FIELD OF THE INVENTION:

The invention relates to a climbing harness, and more particularly to a tree or pole climber accessory for attaching the climber to the upper tibia portion of the leg of the user.

BACKGROUND OF THE INVENTION

Climbing harnesses for lineman and lumberjacks comprise "climbers" of fairly standard construction. One such harness is shown in U.S. Pat. No. 672,755; issued: Apr. 23, 1901. These climbers feature an elongated, rigid metal bar, referred to as a leg iron, that extends under the shank of the shoe or boot of the lineman. On the lower end of the leg iron is a spike or spur for insertion into the pole or tree. The upper end of the leg iron attaches to the upper tibia portion of the lineman's leg by means of a strap which fits into a metal loop in the leg iron. The strap wraps around the tibia portion of the leg, and is secured by a buckle.

It has been observed that the strap tends to cause discomfort to the linemen, particularly after a long period of standing in the harness.

The strap, which is usually a thin strip of leather or nylon, tends to twist and bite into the leg. Blood circulation is often impaired, and the leg iron shank has been known to shift and cause injury.

In order to relieve the discomfort caused by the strap, small padded cushions have been designed to shield the contact area between the inner shank portion of the leg and the strap.

One such shielding pad is illustrated in U.S. Pat. No. 1,727,237; issued: Sept. 3, 1929.

In modern times the padded cushions have been designed to lend greater support to the leg, by featuring an increased wrap-around area.

One such improved wrap-around pad is depicted in the patent to Hobbs; U.S. Pat. No. 4,530,420; issued: July 23, 1985. The pad of the above-identified invention is highly cushioned and extends half-way around the leg, thus providing an increased contact area against chafing and twisting of the strap.

While the aforementioned cushioned pad is most effective for its intended purpose, there exists certain drawbacks to providing complete and sustained comfort, and in providing a padded device which is easily attached and secured to the leg.

The present invention seeks to overcome the drawbacks of these prior devices, while additionally improving the operational ease by which the pad can be secured to the leg. In so providing the added benefits of facilitated securement, the cushioned pad of the present invention has eliminated the need for, and use of, the securing strap.

It was discovered, that most of the problems associated with the attachment of the "climber" to the leg, was a direct result of the securing strap. The strap, if buckled too loosely about the leg, would often twist, and not provide enough support, even with the use of improved wrap-around padding.

On the other hand, if the strap was cinched too tightly about the leg, the blood circulation was often impaired.

It was also observed, that the areas of contact between the straps and the leg not shielded by padding, were often subject to discomfort in cold weather, since the strap did not provide thermal insulation against the environment.

BRIEF SUMMARY OF THE INVENTION

The present invention features a cushioned, wrap-around pad for a "climber", that completely wraps around the entire girth of the upper tibia portion of the leg. By completely encircling and surrounding the shank of the leg, the cushioned pad provides a greater support and contact area between the climber leg iron and the leg. In this manner, the wrap-around pad keeps the entire circumferential leg surface warm and comfortable.

The wrap-around pad of the invention features Velcro-type mating linings, which are integrally formed on the inner and outer wrap-around surfaces of the pad. These hook and loop sections provide several benefits:

(a) they allow for ease of securement of the pad to the climber, and the climber and pad to the leg. It is no longer necessary to fumble with buckles and straps in attaching the climber to one's leg;

(b) the hook and loop sections allow for easy adjustment of the securing pressure provided by the wrap-around pad. Thus, if the pad is too tight or too loose, it can be easily and quickly adjusted to the preference of the user; and (c) the Velcro sections are more durable than the former leather straps, and provide a sturdier, integral pad construction.

It is an object of the present invention to provide an improved climber harness featuring a wrap-around, cushioned pad;

It is another object of this invention to provide a climber harness that is more comfortable and easier to secure to the leg of the user;

It is a further object of the invention to provide a climber harness that eliminates the need for a securing strap.

These and other objects of this invention will be better understood and will become more apparent with reference to the subsequent detailed description considered in conjunction with the accompanying drawings, in which:

DETAILED DESCRIPTION OF THE INVENTION

Generally speaking, the invention pertains to a wrap-around, cushioned pad for use in conjunction with a climber harness. The wrap-around pad provides more comfort and support by completely encircling the entire girth of the upper tibia portion of the leg. The integrally formed Velcro linings eliminate the need for uncomfortable strap, and provide for easily adjustable securement to the leg.

For purposes of brevity, like elements will be given the same designation throughout the figures.

Figure 1:
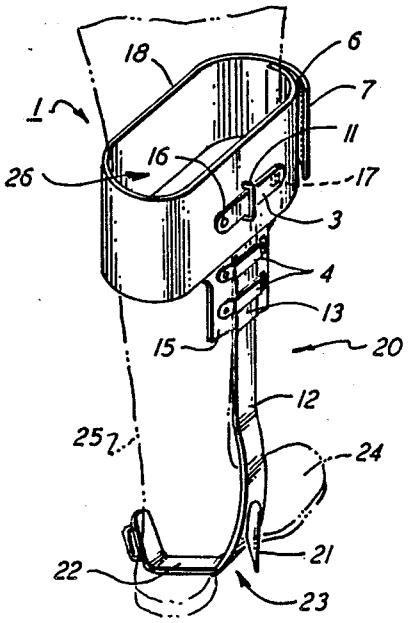
FIG. 1 is a perspective view of the wrap-around, cushioned pad of the invention illustrated in situ with a climber harness.

Now referring to FIG. 1, a climber harness 20 is illustrated in situ with a leg 25 of a lineman or lumberjack, shown in phantom. The climber harness 20 is generally of standard design, and comprises an elongated, rigid metal bar (leg iron) 12 with a spike 21 for insertion into a pole or tree. A curved, foot-plate extension 22 fits within the shank 23 of the boot 24, and acts as a support for the boot.

The climber harness 20 is secured to the upper tibia portion 26 of leg 25 by the cushioned, wrap-around pad 1 of this invention. The pad 1, is secured to the leg iron shank 12 by means of two leather loops 4 that are riveted to a vertical extension pad 15. The leg iron shank 12 is inserted through the loops 4.

The top of leg iron shank 12 incorporates a metal loop 11, that projects through slot 14 (FIG. 2) in the main body 18 of pad 1.

A securing strap 3 is secured to the main body of pad 1 on one end thereof, by a rivet 16. The free end 17 of strap 3 is pushed through metal loop 11, and is secured by a hook or loop patch 10 disposed thereon, that mates with a complementary loop or hook surface 7 on the main body 18 of pad 1.

Patch 10 has either loops or hooks, which mate with either complementary loops or hooks on surface 7, whatever the case may be. The main body 18 of pad 1 is wrapped around the entire circumference of tibia portion 26 of leg 25 and is secured upon itself without the use of a strap, via mating and complementary Velcro-type surfaces 6 and 7, respectively. The inner surface 6 can be lined with loops that mate and secure to the hooks on outer surface 7, or vice versa.

By utilizing mating Velcro-type surfaces 6 and 7, the pad 1 can be sized to accommodate any circumferential length. Also, the pad 1 can be drawing tighter or looser to vary the pressure on the leg surface. Finally, the hook and loop allows for quick attachment of the climber harness 20 to leg 25.

Figure 2:
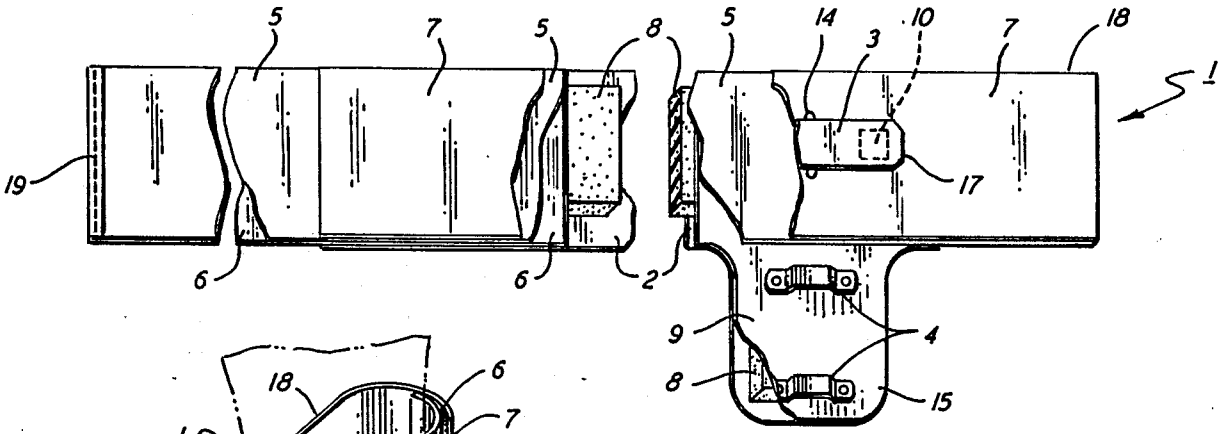
FIG. 2 is a cut-away, plan view of the wrap-around cushioned pad of the invention, as shown in FIG. 1, depicting the overall construction thereof.

Referring to FIG. 2, the overall construction of the wrap-around pad 1 of the invention, shown in FIG. 1, is illustrated.

The pad 1 comprises a four inch nylon webbing layer 5 that is covered by a Velcro-type hook section on its inner surface 6 and a complementary mating loop section on its outer surface 7. The main body 18 of pad 1 is structurally reinforced by a leather section 2, which also includes an opposite leather tab section 9, that makes up vertical extension pad 15.

A compressible foam pad 8 is sandwiched between tab section 9 and leather section 2.

A compressible foam pad 8 is also sandwiched between leather section 2 and the nylon webbing section 5.

The various sections are stitched together, as typically shown by the stitching 19 at the left hand side of main body 18.

The foam pads 8 supply a compressible comfort to the leg 25, when the pad 1 is wrapped thereabout.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent are presented by the subsequently appended claims.

What is claimed is:

1. A wrap-around leg pad for attachment to an upper portion of a tree or pole climber which includes an elongated rigid member having a spur and a boot support on a lower end thereof, said wrap-around pad comprising an elongated, flexible, cushioned pad for complete encirclement of an upper tibia portion of a leg to provide complete wrap-around support and comfort thereto, said elongated flexible cushioned pad further comprising a vertical extension means for supporting said elongated rigid member, and integral securing means for adjustably securing said wrap-around pad upon itself, whereby any sized tibia can be accommodated by said wrap-around pad as it is wrapped about said leg.

2. The wrap-around leg pad of claim 1, wherein said securing means comprises, hook and loop fastener linings which are respectively integral with inner and outer surfaces of said pad.

3. The wrap-around leg pad of claim 1, further comprising means defining a slotted aperture for receiving a loop extending from said elongated rigid member of said climber.

4. The wrap-around leg pad of claim 3, further comprising a retaining strap attached to said pad adjacent said slotted aperture for placement through said loop for securing said loop to said pad.

5. The wrap-around leg pad of claim 4, further comprising hook and loop fastener linings respectively integral with said strap and said pad for securing said strap to said pad after said strap is placed in said loop.

6. The wrap-around leg pad of claim 1, wherein said vertical extension means includes at least one loop retainer member disposed upon said vertical extension means for receiving and securing said elongated rigid member to said vertical extension means.

7. The wrap-around leg pad of claim 6, wherein there are two loop retainer members disposed upon said vertical extension means.

8. The wrap-around leg pad of claim 1, further comprising a compressible inner lining disposed within said elongated flexible pad.

9. The wrap-around leg pad of claim 8, wherein said compressible inner lining includes a foam block section.

10. The wrap-around leg pad of claim 1, wherein said elongated flexible pad includes a layer of nylon webbing.

11. A wrap-around leg pad for use in combination with a tree or pole climber including an elongated rigid member having a spur and a boot support on a lower end thereof, said wrap-around leg pad for attachment to an upper portion of said climber for providing support and comfort for an upper tibia portion of a user's leg, said wrap-around leg pad comprising:

an elongated, flexible pad for encircling an entire girth of said upper tibia portion of said leg to provide complete wrap-around support and comfort thereto, said elongated pad further comprising integral securing means for adjustably securing said elongated flexible pad upon itself, whereby any sized tibia can be accommodated by said elongated pad as it is wrapped around the user's leg.

12. The wrap-around leg pad of claim 11, wherein said securing means comprises, hook and loop fastener linings which are respectively integral with inner and outer surfaces of said pad.

13. The wrap-around leg pad of claim 11, further comprising means defining a slotted aperture for receiving a loop extending from said elongated rigid member of said climber.

14. The wrap-around leg pad of claim 13, further comprising a retaining strap attached to said pad adjacent said slotted aperture for placement through said loop for securing said loop to said pad.

15. The wrap-around leg pad of claim 14, further comprising hook and loop fastener linings respectively integral with said strap and said pad for securing said strap to said pad after said strap is placed in said loop.

16. The wrap-around leg pad of claim 11, having a vertical extension means for supporting said elongated rigid member of said climber.

17. The wrap-around leg pad of claim 16, wherein said vertical extension means includes at least one loop retainer member disposed upon said vertical extension means for receiving and securing said elongated rigid member to said vertical extension means.

18. The wrap-around leg pad of claim 17, wherein there are two loop retainer members disposed upon said vertical extension means.

19. The wrap-around leg pad of claim 11, further comprising a compressible inner lining disposed within said elongated flexible pad.

20. The wrap-around leg pad of claim 19, wherein said compressible inner lining includes a foam block section.

21. The wrap-around leg pad of claim 11, wherein said elongated flexible pad includes a layer of nylon webbing.

22. A wrap-around pad for attachment to an upper end of a tree or pole climber, comprising:

an elongated flexible member having inner and outer surfaces and including a vertical extension means, said elongated member being adaptable for completely wrapping around an upper tibia portion of a leg, wherein said inner surface overlaps said outer surface, and said vertical extension extending down the upper tibia portion and receiving and supporting an elongated, rigid climber bar;

an internally disposed compressible pad positioned within said elongated member for providing supporting comfort to said upper tibia portion; and hook and loop fastener lining sections respectively disposed on said inner and outer surfaces of said elongated flexible member for securing said elongated flexible member upon itself as it is completely wrapped around said upper tibia portion of said leg.

23. A wrap-around leg pad for attachment to an upper portion of a tree or pole climber which includes an elongated rigid member having a spur and a boot support on a lower end thereof, said wrap-around pad comprising an elongated, flexible, cushioned pad for complete encirclement of an upper tibia portion of a leg to provide complete wrap-around support and comfort thereto, said elongated flexible cushioned pad further comprising means defining a slotted aperture for receiving a loop extending from said elongated rigid member, and integral securing means for adjustably securing said wrap-around pad upon itself, whereby any sized tibia can be accommodated by said wrap-around pad as it is wrapped about said leg.

* * * * *

US004938313C1

(12) EX PARTE REEXAMINATION CERTIFICATE (5248th)

United States Patent
Rullo et al.

(10) Number: US 4,938,313 C1
(45) Certificate Issued: Dec. 27, 2005

(54) CUSHIONED WRAP-AROUND PAD FOR USE WITH A POLE OR TREE CLIMBER

(75) Inventors: James J. Rullo, Elmira, NY (US); Mark A. Colian, Binghamton, NY (US)

(73) Assignee: Buckingham Manufacturing Company, Inc., Binghamton, NY (US)

Reexamination Request:
No. 90/006,000, May 7, 2001

Reexamination Certificate for:

| | |
|---|---|
| Patent No.: | **4,938,313** |
| Issued: | **Jul. 3, 1990** |
| Appl. No.: | **07/280,772** |
| Filed: | **Dec. 7, 1988** |

(51) Int. Cl.[7] ..... A63B 27/00

(52) U.S. Cl. ..... 182/221; 182/134

(56) References Cited

U.S. PATENT DOCUMENTS

| | | | | |
|---|---|---|---|---|
| 1,727,237 | A | * | 9/1929 | Katz ..... 182/221 |
| 2,760,705 | A | | 8/1956 | McIntire |
| 3,414,083 | A | | 12/1968 | Rininger |
| 3,589,359 | A | | 6/1971 | Hill |
| 4,572,169 | A | | 2/1986 | Mauldin et al. |
| 4,628,925 | A | | 12/1986 | Witzel |
| 4,771,768 | A | | 9/1988 | Crispin |
| 4,905,715 | A | | 3/1990 | Johnson |
| 4,938,313 | A | | 7/1990 | Rullo et al. |

* cited by examiner

*Primary Examiner*—Alvin Chin-Shue

(57) ABSTRACT

The invention features a wrap-around pad that attaches to a climber harness for securing the climber harness to a leg of a lineman or lumberjack.

The wrap-around pad completely encircles the circumference of the upper tibia portion of the leg, thus providing increased support and comfort to the leg. The surfaces of the pad is covered by Velcro-type mating linings comprising hooks and loops, such that the pad adjusts to the leg size by securing itself to itself. This allows for securement to the leg without the use of straps, and allows for quick release and adjustment.

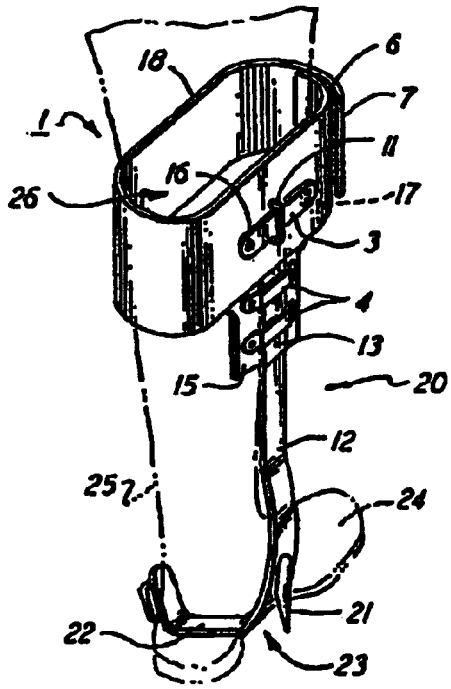

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–23 are cancelled.

* * * * *